US011267254B2

(12) United States Patent
Sauer et al.

(10) Patent No.: US 11,267,254 B2
(45) Date of Patent: Mar. 8, 2022

(54) FLUID RECIRCULATION WITHIN PRINTING DEVICE RESERVOIR VIA EXTRACTION PUMP AND SUPPLY PUMP

(71) Applicant: Hewlett-Packard Development Company, L.P., Spring, TX (US)

(72) Inventors: Russell Sterling Sauer, Vancouver, WA (US); Kenneth Williams, Vancouver, WA (US); Wesley R. Schalk, Vancouver, WA (US); Christopher John Arnold, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/255,166

(22) PCT Filed: Sep. 27, 2018

(86) PCT No.: PCT/US2018/053178
§ 371 (c)(1),
(2) Date: Dec. 22, 2020

(87) PCT Pub. No.: WO2020/068088
PCT Pub. Date: Apr. 2, 2020

(65) Prior Publication Data

US 2021/0260888 A1 Aug. 26, 2021

(51) Int. Cl.

| | |
|---|---|
| ***B41J 2/18*** | (2006.01) |
| ***B41J 2/175*** | (2006.01) |
| ***B41J 29/38*** | (2006.01) |

(52) U.S. Cl.
CPC ..... *B41J 2/18* (2013.01); *B41J 2/17556* (2013.01); *B41J 2/17596* (2013.01); *B41J 29/38* (2013.01)

(58) Field of Classification Search
CPC . B41J 2/18; B41J 2/17596; B41J 29/38; B41J 2/17566; B41J 2/17556; B41J 2/175; B41J 2/17509
See application file for complete search history.

(56) References Cited

U.S. PATENT DOCUMENTS

| | | | | |
|---|---|---|---|---|
| 4,346,388 | A | 8/1982 | Wiley | |
| 6,213,601 | B1 | 4/2001 | Akuzawa et al. | |
| 7,841,706 | B2 | 11/2010 | Ishinaga et al. | |
| 8,177,313 | B2 | 5/2012 | Suzuki et al. | |
| 8,336,997 | B2 * | 12/2012 | Katada | B41J 2/175 347/85 |

(Continued)

*Primary Examiner* — An H Do
(74) *Attorney, Agent, or Firm* — Michael A Dryja

(57) ABSTRACT

An extraction pump of a printing device fluidically connected to a reservoir of the printing device is set to a specified rotational velocity. A pulse-width modulation (PWM) value of the extraction pump correspondingly increases until the extraction pump rotates at the specified rotational velocity. While the power of the extraction pump is monitored, a power of a supply pump of the printing device fluidically connected between the extraction pump and the reservoir is continually increased; the power of the extraction pump correspondingly decreases to maintain rotation of the extraction pump at the specified rotational velocity. Responsive to the power of the extraction pump decreasing to a characterized value for the specified rotational velocity, the power of the supply pump ceases being increased.

15 Claims, 4 Drawing Sheets

(56) References Cited

U.S. PATENT DOCUMENTS

| | | | | |
|---|---|---|---|---|
| 8,616,690 | B2 | 12/2013 | Saito et al. | |
| 8,888,210 | B2 * | 11/2014 | Uptergrove | B41J 2/18 347/7 |
| 9,162,507 | B2 * | 10/2015 | Tanaka | B41J 2/17566 |
| 10,357,977 | B2 * | 7/2019 | Mukoyama | B41J 29/02 |
| 10,766,265 | B2 * | 9/2020 | Tokisawa | B41J 29/02 |
| 2009/0040250 | A1 | 2/2009 | Suzuki | |
| 2010/0259575 | A1 | 10/2010 | Uptergrove | |
| 2011/0285767 | A1 | 11/2011 | Tanaka et al. | |

* cited by examiner

FLUID RECIRCULATION WITHIN PRINTING DEVICE RESERVOIR VIA EXTRACTION PUMP AND SUPPLY PUMP

BACKGROUND

Printing devices, such as standalone printers, are devices that output colorant onto print media like paper to form images on the print media. One type of printing device is an inkjet-printing device, which is more generally a fluid-ejection device. An inkjet-printing device can print ink of different colors corresponding to the colors of a color space to form full color images on print media. Another type of printing device is a three-dimensional (3D) printing device, which creates physical objects over three dimensions by printing multiple thin layers of print material.

DETAILED DESCRIPTION

Figure 1:
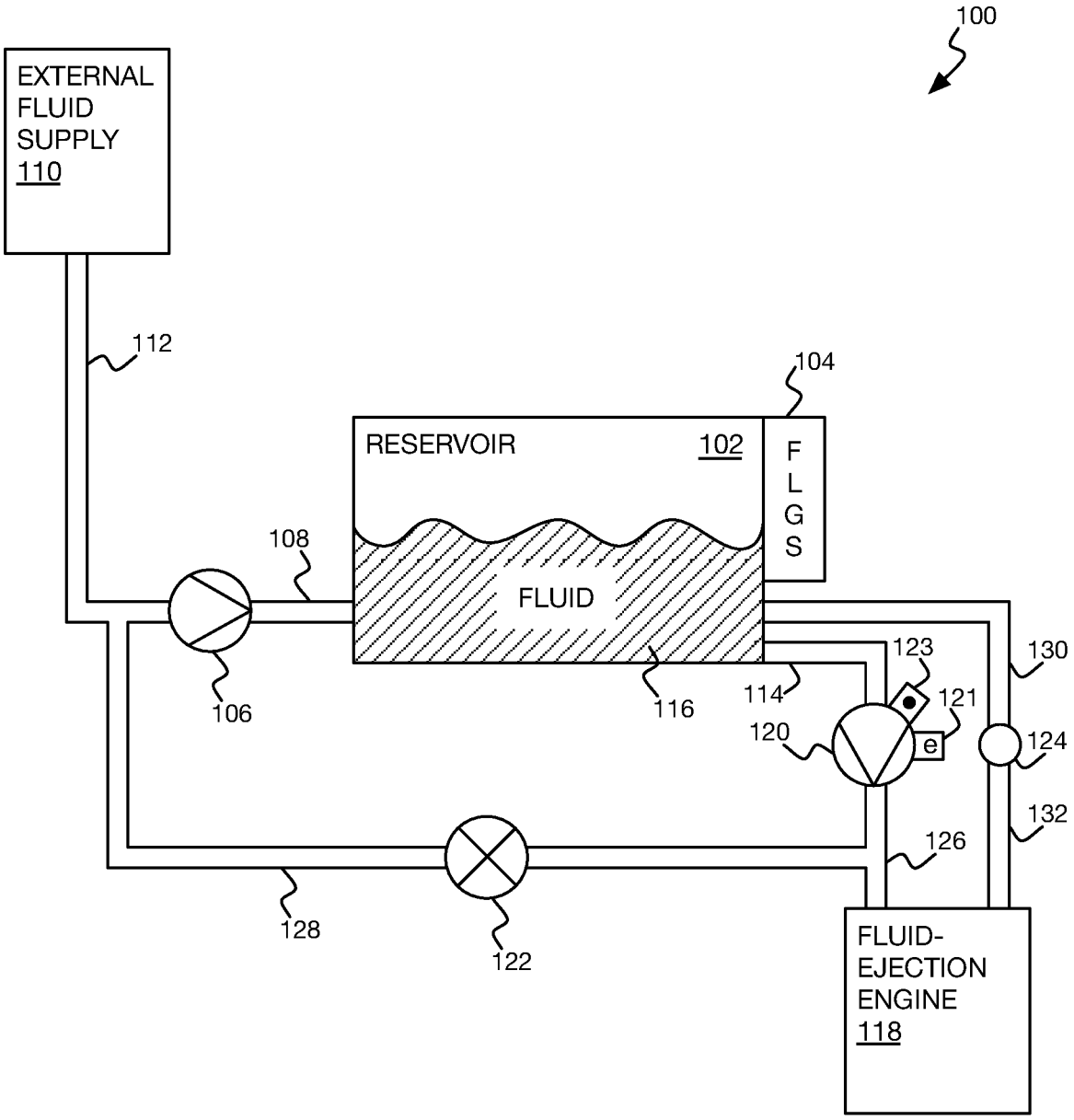
FIG. 1 is a diagram of a portion of an example fluid-ejection device.

As noted in the background section, one type of printing device is an inkjet-printing device, which is more generally a fluid-ejection device. Inkjet-printing devices can include those used in smaller residential, office, and even enterprise environments, in which ink supplies may be integrated within printheads and self-contained within the devices themselves. In large-scale commercial and some enterprise environments, however, due to the continuous nature of the printing that occurs within these environments or for cost considerations, the ink supplies may be located external to the printing devices, permitting the usage of larger supplies of ink. In a sort of hybrid of these two types of printing devices, a printing device may include an internal reservoir that is periodically refilled from an external ink supply.

While the reservoir is usually of smaller capacity than the external ink supply and replenished as the printing device outputs ink onto media, there can be times during which the printing device is unused with the same ink residing in the reservoir for an extended length of time. Some types of ink include pigments suspending within a base liquid. The pigments may settle at the bottom of the reservoir if the printing device is unused for extended lengths of time. Therefore, periodically the ink within the reservoir should be recirculated to ensure that when the printing device does print again, print quality does not suffer.

Rather than having a dedicated recirculation pump to recirculate ink within the reservoir, other pumps already present within the printing device may be used to also recirculate the ink. For instance, the printing device can include a supply pump that transfers ink from the external ink supply to the reservoir, and an extraction pump that transfers ink from the reservoir to the print engine that forms images on media using the ink. The extraction pump may also be used to extract the ink from the reservoir back to the external ink supply, or otherwise to drain the reservoir of ink. Therefore, a fluidic channel from the outlet side of the extraction pump to the inlet side of the supply pump, with an intervening valve, can be added so that the pumps can also be used to recirculate ink within the reservoir.

Cost, space, and other constraints can dictate the types of pumps that may be used as the supply and extraction pumps. For instance, the extraction pump may include an encoder that can be used to measure the rotational velocity of the pump, and thus the flow rate of fluid through the pump. By comparison, the supply pump may not include such an encoder. The extraction pump can therefore be controlled by specifying a desired rotational velocity for the pump, with the pump's controller increasing power, such as a pulse-width modulation (PWM) value, until the desired rotational velocity is maintained. By comparison, the supply pump may be controlled just by directly setting the power, like the PWM value, of the pump.

A pump may generally have an optimal performance efficiency for a given rotational velocity. If the pump has to operate using too much power to realize a desired rotational velocity as compared to a known optimal performance efficiency for this rotational velocity, which can be generally considered a characterized value for this rotational velocity, then the pump is encountering more fluidic backpressure than for which it is designed. Stated another way, the pump is undersized for what it is being asked to do, which besides resulting in higher power consumption and thus operating cost, can affect longevity of the pump.

If an extraction pump is asked to by itself recirculate ink within the reservoir, by pushing ink from the reservoir through the recirculation channel and through the supply pump back into the reservoir, the resulting backpressure against the extraction pump is typically more than what the extraction pump encounters when just transferring ink to the print engine for printing. Therefore, using just the extraction pump to recirculate ink within the reservoir is not optimal. However, because the supply pump may not include an encoder, it is difficult to also run the supply pump in equilibrium with the extraction pump to assist with ink recirculation. Therefore, one pump may be working harder than the other pump, which can actually result in potential damage to the lesser working pump if there is insufficient backpressure against it (e.g., the pump may "burn out").

Techniques described herein ameliorate these shortcomings, by effectively leveraging the encoder at the extraction pump so that both the supply pump and the extraction pump operate in equilibrium when used to recirculate ink within a reservoir. Once a recirculation valve is opened between the extraction and supply pumps, the extraction pump is set to run at a specified rotational velocity. The extraction pump will increase its power until this rotational velocity is achieved. The power usage is larger than the characterized power value corresponding to optimal power efficiency than the pump, insofar as the backpressure against the extraction pump is high when the extraction pump alone has to recirculate fluid within the reservoir.

The supply pump is then started and its power continually increased (such as continuously or in a stepped manner). As the power of the supply pump is increased, the backpressure against the extraction pump decreases because the supply pump is increasingly assisting the extraction pump in recirculating fluid within the reservoir. Therefore, the extraction pump will correspondingly decrease its power to maintain the specified rotational velocity. This process continues—increasing the power of the supply pump, which results in a corresponding decrease in power of the extraction pump—until the power at the extraction pump decreases to the characterized power value corresponding to optimal power efficiency for the specified rotational velocity.

As such, the extraction pump and the supply pump work in unison to recirculate fluid within the reservoir. The supply pump may not have an encoder by which to monitor the rotational velocity of the pump. Nevertheless, operational equilibrium between the extraction pump and the supply pump is achieved by leveraging the encoder of the extraction pump for both pumps.

FIG. 1 shows a portion of an example fluid-ejection device 100. The fluid-ejection device 100 can be an inkjet-printing device, in which case the fluid that the device 100 ejects can include ink. The fluid-ejection device 100 can include a reservoir 102, a fluid level gauge sensor 104 for the reservoir 102, and a supply pump 106. The reservoir 102 and the supply pump 106 are fluidically interconnected via a fluid channel 108, which can include tubing, and by which the supply pump 106 inlets the fluid 116 into the reservoir 102.

The fluid level gauge sensor 104 monitors the level of fluid 116 within the reservoir 102. During initial filling of the reservoir 102 from the external fluid supply 110, monitoring the level of fluid 116 within the reservoir 102 avoids overfilling of the reservoir 102. During draining of the reservoir 102 back to the external fluid supply 110, monitoring the level of fluid 116 within the reservoir 102 confirms when the reservoir 102 has been drained. During ejection of fluid from the fluid-ejection device 100 by a fluid-ejection engine 118, monitoring the level of fluid 116 within the reservoir 102 is performed so that when the level is low, additional fluid from the external fluid supply 110 can be transferred to the reservoir 102 to replenish the fluid 116 within the reservoir 102.

Another fluid channel 114 is fluidically connected to the reservoir 102, from which the fluid 116 is outlet towards the fluid-ejection engine 118 of the device 100. The fluid channel 114 can also include tubing. The fluid-ejection engine 118 is or includes the components of the fluid-ejection device 100 that actually eject fluid from the device 100. For instance, in the case of an inkjet-printing device, the fluid-ejection engine 118 can be or include an inkjet printhead, or multiple printheads, which can output the fluid onto a print medium like paper to form an image on the medium. Such printheads can be considered a print mechanism by which images are printed on print media.

A fluid supply 110 can be external and removably connectable to the fluid-ejection device 100. The supply pump 106 is fluidically interconnected with the fluid supply 110 via a fluid channel 112. The fluid channel 112 can, like fluid channels 108 and 114, include tubing. The supply pump 106 thus fluidically interconnects the reservoir 102 and the external fluid supply 110, via the fluid channels 108 and 112, to transfer fluid from the fluid supply 110 to the reservoir 102. It is noted that there can be a supply pump 106 and a reservoir 102, with associated fluid channels 108, 112, and 114 and an associated fluid supply 110, for each different type of fluid that the fluid-ejection device 100 uses. For instance, if the fluid-ejection device 100 is an inkjet-printing device, then there may be a supply pump 106, a reservoir 102, and so on, for each different color of ink that the device 100 can output.

The fluid-ejection device 100 can also include an extraction pump 120, a recirculation valve 122, and a pressure control device 124. The extraction pump 120 can be used to extract, or drain, the fluid 116 from the reservoir 102 back to the external fluid supply 110, and also to transfer fluid from the reservoir 102 to the fluid-ejection engine 118. The extraction pump 120 also can recirculate the fluid 116 within the reservoir 102; the supply pump 106 can cooperatively assist the extraction pump 120 in such fluid recirculation.

The extraction pump 120 includes an encoder 121 by which the rotational velocity of the pump 120 can be measured and thus monitored. Insofar as the flow rate of fluid through the extraction pump 120 corresponds to the rotational velocity in a linear or other manner, the encoder 121 also then permits monitoring of the flow rate of fluid through the pump 120. The term encoder is usually generally herein to mean any type of pump revolution sensor, and may be an optical or magnetic encoder.

The extraction pump 120 can include a controller 123, such as a hardware controller like an application-specific integrated circuit (ASIC), a field-programmable gate array (FPGA), or another type of IC. The extraction pump 120 can thus be controllable by setting the desired rotational velocity of the pump 120 through the controller 123. The controller 123 can continually adjust the power applied to the pump 120, such as by adjusting a PWM value of the pump 120, to maintain the pump 120 at the specified rotational velocity as indicated by the encoder 121, regardless of the fluidic backpressure against the pump 120.

By comparison, the supply pump 106 may lack either or both of an encoder and a corresponding controller. Rather, the supply pump 106 may be more simply controlled, by directly specifying the power applied to the pump 106, such as by directly controlling the PWM value of the pump 120. The power applied to the supply pump 106, though, does not by itself correlate to the fluidic flow rate through the pump 106—the flow rate also depends on the backpressure against the pump 106 in addition to applied power. Stated another way, without an encoder or another manner by which to indirectly or directly measure the fluidic flow rate through the supply pump 106, the direct control of just the power of the supply pump 106 does not permit precise flow rate control.

The reservoir 102 and the extraction pump 120 are fluidically interconnected via the fluid channel 114, by which the pump 120 extracts the fluid 116 from the reservoir 102. Another fluid channel 126 fluidically connects the extraction pump 120 to both the fluid-ejection engine 118 and the valve 122. At the other side of the valve 122, a fluid channel 128 fluidically interconnects the valve 122 to the tubing 112, and thus to the supply pump 106 and the external fluid supply 110. The fluid channels 126 and 128 can also each include tubing. The valve 122 controls whether fluid is permitted to flow from the channel 126 to the channel 128 when the extraction pump 120 is running.

The pressure control device 124 fluidically connects to the reservoir 102 via a fluid channel 130, and to the fluid-ejection engine 118 via a fluid channel 132. Like the other fluid channels, the channels 130 and 132 can each include tubing. The pressure control device 124 can also be referred to as a fluid flow restriction device, and is connected between the reservoir 102 and the fluid-ejection engine 118 in parallel with the extraction pump 120. When the extraction pump 120 is running to supply the fluid 116 from the reservoir 102 to the fluid-ejection engine 118 during printing, the pressure control device 124 maintains the fluidic pressure at the engine 118 at a relatively constant level.

Figure 2:
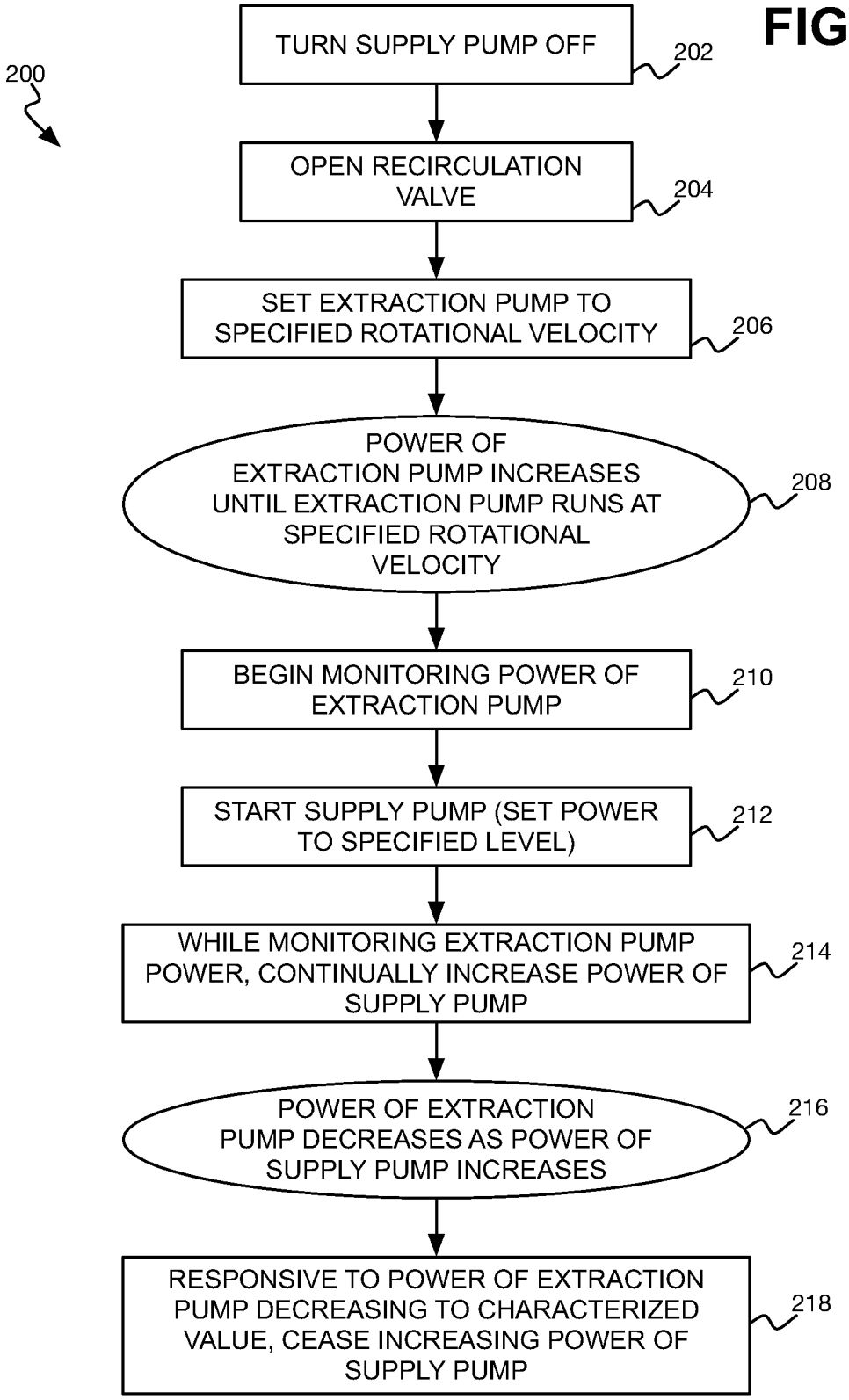
FIG. 2 is a flowchart of an example method for recirculating fluid within a fluid-ejection device.

FIG. 2 shows an example method 200 for recirculating the fluid 116 within the reservoir 102 of the fluid-ejection device 100, using the extraction pump 120 and the supply pump 106. The method 200 can be implemented as instructions or other program code stored on a non-transitory computer-readable data storage medium and executed by the fluid-ejection device. For example, a processor or other hardware logic of the fluid-ejection device 100 can perform the method 200. It is noted that the method 200 may be performed regardless of whether the external fluid supply 110 is attached or otherwise present within the fluid-ejection device 100.

The supply pump 106 may be turned off if the pump 106 is currently running (202), and the recirculation valve 122 opened if the valve is currently closed (204). The extraction pump 120 is set to a specified rotational velocity (206). The specified rotational velocity may be the velocity at which the extraction pump 120 is known to rotate to transfer fluid through the pump 120 at a desired flow rate. The extraction pump 120 may be set to the specified rotational velocity by communicating the specified velocity to the controller 123 for the pump 120.

The controller 123 of the extraction pump 120 increases the power of the pump 120 until the pump 120 is running at the specified rotational velocity (208), such as by increasing its PWM value. The controller 123 monitors the rotational velocity of the extraction pump 120 via the encoder 121. The PWM value may specify the percentage of each pump cycle that the extraction pump 120 is receiving power, such as the duty cycle of the pump 120. In short order, the extraction pump 120 may plateau at a relatively constant power to realize the specified rotational velocity.

Monitoring of the power of the extraction pump 120 begins once the pump 120 has been set to the specified rotational velocity (210), and the supply pump 106 is started by setting its power (e.g., the PWM value of the pump 106) to an initial specified value (212), which may be just greater than zero. As noted above, the extraction pump 120 is controlled, or driven, by setting its rotational velocity to a specified rotational velocity, such that the controller 123 of the pump 120 monitors the actual rotational velocity of the pump 120 via the encoder 121 and responsively maintains the velocity at the specified velocity by adjusting the power of the pump 120. By comparison, the supply pump 106 is driven by directly setting its power. Monitoring of the rotational velocity of the supply pump 106—including by the pump 106 itself—may not be possible, since the pump 106 may lack an encoder.

While monitoring of the power of the extraction pump 120 continues, the power of the supply pump 106 is continually increased (214) (e.g., the power of the supply pump 106 can be ramped up from a zero power level). As the power of the supply pump 106 increases, the pump 106 increasingly assists the extraction pump 120 in recirculating fluid within the reservoir 102. Therefore, the extraction pump 120 does not have to work as hard to maintain the specified rotational velocity. The extraction pump 120 encounters less fluidic backpressure, such that the controller 123 responsively decreases the power of the pump 120 to maintain (and not increase) the rotational velocity of the pump 120 at the specified velocity (216).

Once the power of the extraction pump 120 decreases to a characterized value or level for the specified rotational velocity, the power of the supply pump is no longer increased (218). The characterized value for the specified rotational velocity indicates the power of the extraction pump 120 at which pump 120 rotates at this specified velocity with an optimal performance efficiency. To achieve a given rotational velocity, the extraction pump 120 runs most efficiently (i.e., consumes minimum power) when the pump 120 encounters a particular amount of backpressure. Therefore, the supply pump 106 has its power increased to sufficiently pump fluid so that the backpressure at the extraction pump 120 decreases to the level at which the extraction pump 120 runs most efficiently while rotating at the specified rotational velocity. The amount or level of power for this rotational velocity can be the characterized value, and can be pump and rotational velocity dependent.

The result of the method 200 is that the extraction pump 120 and the supply pump 106 cooperatively recirculate the fluid 116 within the reservoir 102. It is noted that in the method 200, the initial specified level to which the supply pump 106 has its power set in part 212 is sufficiently low so that, for the controller 123 to maintain the rotational velocity of the extraction pump 120, the pump 120 runs at higher power than the characterized value. That is, the supply has its power set to a specified power lower than a sufficient power of the supply pump 106 for the power of the extraction pump 120 to operate at the characterized value for the specified rotational velocity at which the extraction pump 120 is rotating. Otherwise, subsequently increasing the power of the supply pump 106 will not result in the extraction pump 120 ever running at the characterized value; rather the absolute difference between the power of the pump 120 and the characterized value will increase and not decrease.

The method 200 that has been described can be periodically repeated over time to calibrate the supply pump 106 vis-à-vis the extraction pump 120 as the pumps 106 and 120 wear and lose efficiency or performance as the pumps 106 and 120 age. For example, once the method 200 is performed, the amount of power to apply to the supply pump 106 so that the extraction pump 120 operates at the characterized value for the specified rotational velocity is determined. When recirculation of fluid 116 within the reservoir 102 is desired without having to perform the method 200, the extraction pump 120 may thus be set to the specified rotational velocity when the method 200 was performed, and the supply pump 106 set to the amount of power determined when the method 200 was performed. When the method 200 is performed, therefore, the final value to which the power of the supply pump 106 has been increased can be stored.

Figure 3A:
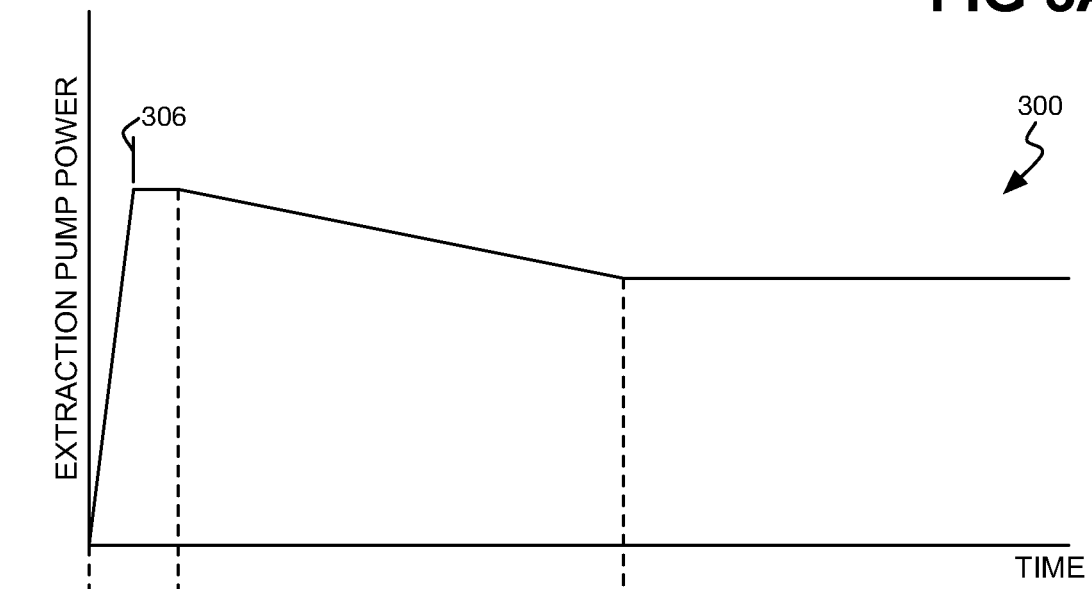
FIGS. 3A and 3B are example graphs of pump power over time of an extraction pump and a supply pump of a fluid-ejection device as the method of FIG. 2 is performed.
Figure 3B:
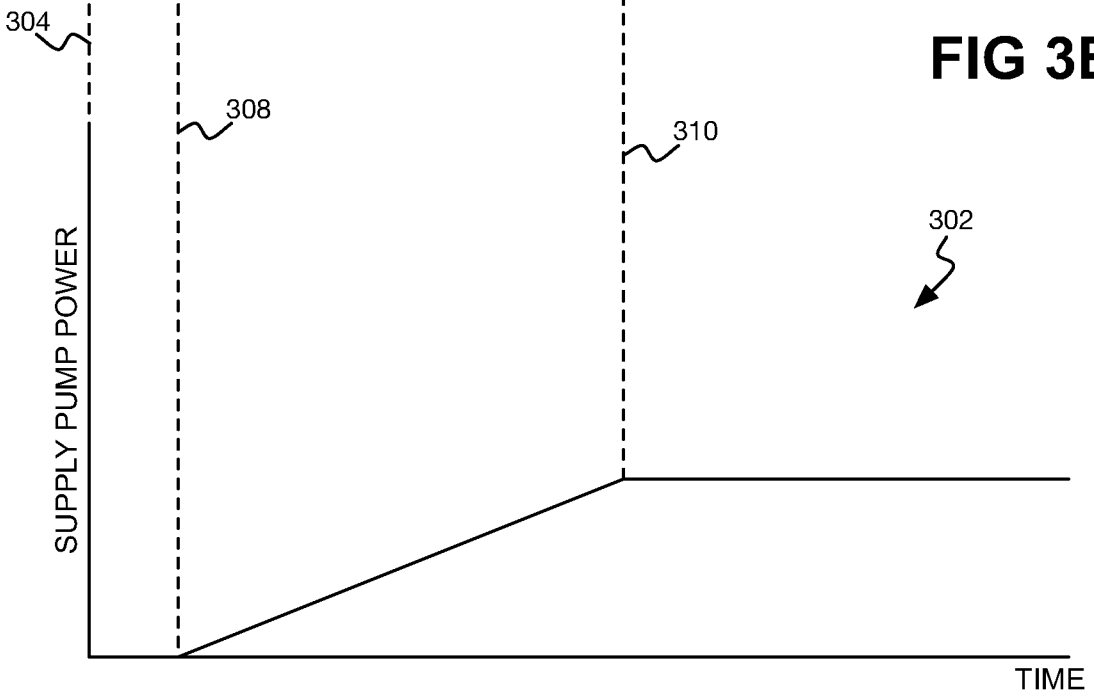

FIGS. 3A and 3B show graphs 300 and 302, respectively, which illustratively depict example performance of the method 200 via pump power-over-time graphs of the extraction pump 120 and the supply pump 106, respectively. The x-axis in each of the graphs denotes time, whereas the y-axis of the graph of FIG. 3A denotes power of the extraction pump 120 and the y-axis of the graph of FIG. 3B denotes power of the supply pump 106. The scales of the y-axes of the two graphs are not necessarily identical, however; rather, the graphs indicate how power of the extraction pump 120 increases or decreases as the power of the supply pump 106 is increased or decreased.

At time 304, the supply pump 106 has been turned off, the recirculation valve 122 opened, and the extraction pump 120 set to a specified rotational velocity, per parts 202, 204, and 206 of the method 200. The controller 123 increases the power of the extraction pump 120 until encoder 121 indicates the pump 120 has reached the specified rotational velocity, at time 306, per part 208 of the method 200. Monitoring of the power of the extraction pump 120 may begin, and the supply pump 106 can then be started, per parts 210 and 212 of the method 200, as indicated in FIGS. 3A and 3B as occurring at time 308.

The power of the supply pump 106 is increased while monitoring of the power of the extraction pump 120 continues, per part 214 of the method 200. As such, the controller 123 correspondingly decreases the power of the extraction pump 120, per part 216 of the method 200. At time 310, the power of the extraction pump 120 reaches its characterized value for the specified rotational velocity, and the continued increasing of the power of the supply pump 106 is stopped, per part 218 of the method 200. The steady state power values that the pumps 106 and 120 reach can be different from one another; the rate at which power of the supply pump 106 increases can differ from the rate at which power of the extraction pump 120 decreases. This is because the pumps 106 and 120 can be sized differently to accommodate cost, space, and other constraints.

Figure 4:
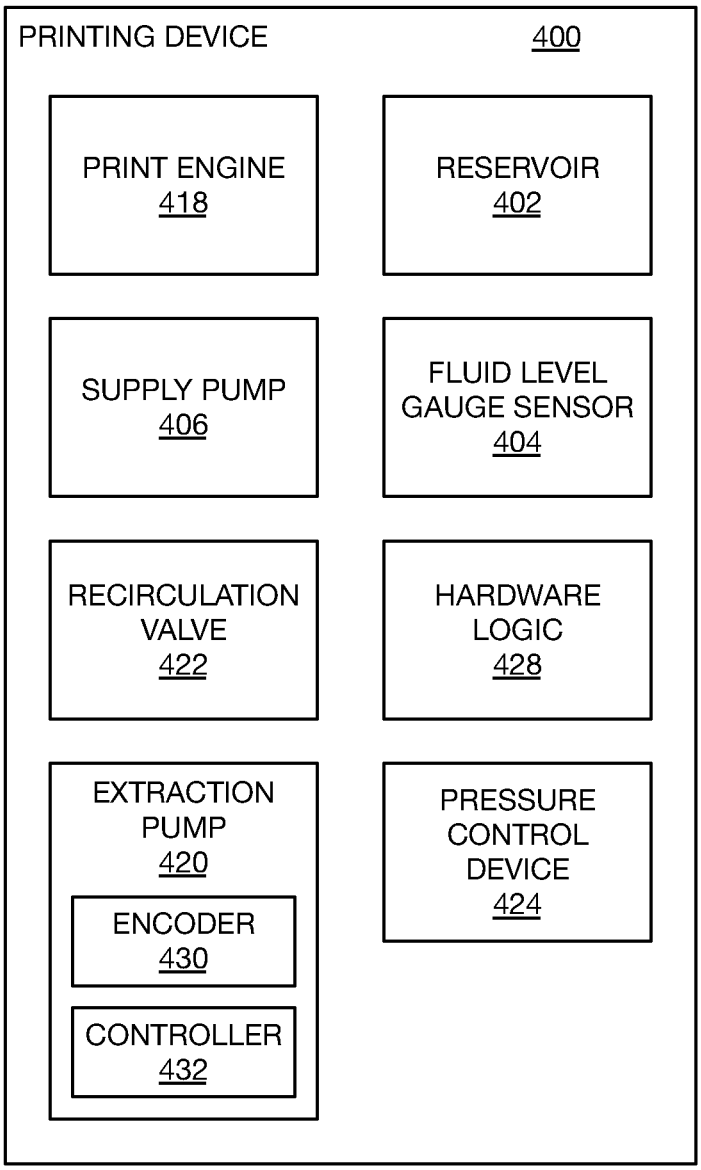
FIG. 4 is a block diagram of an example fluid-ejection device.

FIG. 4 shows an example printing device 400. The printing device 400 is an implementation of the fluid-ejection device 100 that has been described, and may be an inkjet-printing device, or another type of printing device that ejects fluid like ink. The printing device 400 may be a standalone printer, for instance, or an all-in-one (AIO) or a multifunction device (MFD) that includes printing functionality in addition to other functionality, such as copying, scanning, faxing, and so on. The printing device 400 may be a three-dimensional (3D) printing device, such as a standalone 3D printer, which creates a physical object over three dimensions by printing multiple thin layers of print material, which is encompassed under the rubric ink herein.

The printing device 400 includes a print engine 418, which is an implementation of the fluid-ejection engine 118 that has been described. The print engine 418 outputs fluid, such as ink, onto print media like paper. The print engine 418 can thus form images on the print media using the fluid. The printing device 400 includes a reservoir 402, a supply pump 406, and a fluid level gauge sensor 404, which respectively correspond to the reservoir 102, the supply pump 106, and the fluid level gauge sensor 104 that have been described. The printing device 400 includes an extraction pump 420, corresponding to the extraction pump 120 of FIG. 1, and which itself can include an encoder 430 and a controller 432, which respectively correspond to the encoder 121 and the controller 123. Similarly, the printing device 400 can include a recirculation valve 422 and a pressure control device 424, which respectively correspond to the recirculation valve 122, and the pressure control device 124 that have been described.

The printing device 400 includes hardware logic 428. The hardware logic 428 includes a non-transitory computer-readable data storage medium that stores program code. For instance, the hardware logic 428 can include a general purpose processor that executes the program code, or can include special purpose hardware, like an application-specific integrated circuit (ASIC), which effectuates the program code. The hardware logic 428 can perform the method 200 of FIG. 2 that has been described. As such, the hardware logic 428 can set the extraction pump 120 to a specified rotational velocity and then continually increase the power of the supply pump 106 until the power of the extraction pump 120 decreases to a characterized value for the specified velocity.

The techniques that have been described provide for an extraction pump and a supply pump cooperatively recirculating fluid within a reservoir of a fluid-ejection device. The supply pump can sufficiently assist with fluid recirculation so that the extraction pump operates at optimal performance efficiency for the rotational velocity to which the extraction pump has been set, and thus for the desired fluidic flow rate at which fluid recirculation occurs. The extraction pump's encoder in this respect can thus be leveraged to effectively be used as an encoder for the supply pump as well, when the supply pump lacks its own actual encoder.

We claim:

1. A non-transitory computer-readable data storage medium storing program code executable by a printing device to:

set an extraction pump of the printing device fluidically connected to a reservoir of the printing device to a specified rotational velocity, a power of the extraction pump correspondingly increasing until the extraction pump rotates at the specified rotational velocity;

while monitoring the power of the extraction pump, continually increase a power of a supply pump of the printing device fluidically connected between the extraction pump and the reservoir, the power of the extraction pump correspondingly decreasing to maintain rotation of the extraction pump at the specified rotational velocity; and responsive to the power of the extraction pump decreasing to a characterized value for the specified rotational velocity, cease increasing the power of the supply pump.

2. The non-transitory computer-readable data storage medium of claim 1, wherein the characterized value for the specified rotational velocity indicates the power of the extraction pump for the extraction pump to rotate at the specified rotational velocity at an optimal performance efficiency of the extraction pump.

3. The non-transitory computer-readable data storage medium of claim 1, wherein the extraction pump is driven by setting a rotational velocity of the extraction pump to the specified rotational velocity, a controller of the extraction pump monitoring the rotational velocity and responsively maintaining the rotational velocity at the specified rotational velocity by adjusting the power of the extraction pump, and wherein the supply pump is driven by setting the power of the supply pump, the supply pump unable to monitor a rotational velocity of the supply pump.

4. The non-transitory computer-readable data storage medium of claim 1, wherein the extraction pump has an encoder by which a controller of the extraction pump monitors a rotational velocity of the extraction pump to maintain the rotational velocity at the specified rotational velocity by responsively adjusting the power of the extraction pump, and wherein the supply pump lacks any encoder by which to a monitor a rotational velocity of the supply pump.

5. The non-transitory computer-readable data storage medium of claim 1, wherein the extraction pump transitions fluid from the reservoir, and the supply pump transitions the fluid into the reservoir, and wherein the extraction pump and the supply pump cooperatively recirculate the fluid within the reservoir.

6. The non-transitory computer-readable data storage medium of claim 1, wherein the program code is executable by the printing device further to:

open a recirculation valve of the printing device fluidically connected between the extraction pump and the supply pump to recirculate fluid within the reservoir via the extraction pump and the supply pump.

7. The non-transitory computer-readable data storage medium of claim 1, wherein the program code is executable by the printing device further to:

prior to continually increasing the power of the supply pump, set the power of the supply pump to a specified power lower than a sufficient power of the supply pump for the power of the extraction pump to operate at the characterized value for the specified rotational velocity at which the extraction pump is rotating.

8. A printing device comprising:

a reservoir;

an extraction pump fluidically coupled to the reservoir;

a supply pump fluidically coupled to the reservoir and to the extraction pump, the extraction pump and the supply pump cooperatively recirculating fluid within the reservoir; and hardware logic to set the extraction pump to a specified rotational velocity and then continually increase a power of the supply pump until a power of the extraction pump correspondingly decreases to a characterized value for the specified rotational velocity.

9. The printing device of claim 8, further comprising:

a print engine to output the fluid on media; and a recirculation valve of the printing device fluidically connected between the extraction pump and the supply pump, wherein the extraction pump is fluidically coupled to the print engine to provide the fluid to the print engine, wherein the supply pump is fluidically coupled to a fluid supply to provide the fluid from the fluid supply to the reservoir that the extraction pump is to provide to the print engine, and wherein the hardware logic is to open the recirculation valve to permit recirculation of the fluid within the reservoir via the extraction pump and the supply pump.

10. The printing device of claim 8, wherein prior to continually increasing the power of the supply pump, the hardware logic is to set the power of the supply pump to a specified power lower than a sufficient power of the supply pump for the power of the extraction pump to operate at the characterized value for the specified rotational velocity at which the extraction pump is rotating.

11. The printing device of claim 10, wherein prior to setting of the power of the supply pump to the specified power and after setting of the extraction pump to the specified rotational velocity, the power of the extraction pump correspondingly increases until the extraction pump rotates at the specified rotational velocity.

12. The printing device of claim 8, wherein the power of the extraction pump correspondingly decreases as the power of the supply pump increases to maintain rotation of the extraction pump at the specified rotational velocity.

13. The printing device of claim 8, wherein the characterized value for the specified rotational velocity indicates the power of the extraction pump for the extraction pump to rotate at the specified rotational velocity at an optimal performance efficiency of the extraction pump.

14. The printing device of claim 8, wherein the extraction pump comprises a controller to monitor a rotational velocity of the extraction pump and maintain the rotational velocity at the specified rotational velocity by responsively adjusting the power of the extraction pump, wherein the extraction pump is driven by setting the rotational velocity of the extraction pump to the specified rotational velocity, and wherein the supply pump is driven by setting the power of the supply pump, the supply pump unable to monitor a rotational velocity of the supply pump.

15. The printing device of claim 8, wherein the extraction pump comprises a controller and an encoder by which the controller monitors a rotational velocity of the extraction pump to maintain the rotational velocity at the specified rotational velocity by responsively adjusting the power of the extraction pump, and wherein the supply pump lacks any encoder by which to a monitor a rotational velocity of the supply pump.

* * * * *